United States Patent [19]

Ratliff et al.

[11] 4,089,166

[45] May 16, 1978

[54] AUTOMATIC PUMP CONTROL SYSTEM

[75] Inventors: Frank W. Ratliff; James R. McBurnett, both of Corinth, Miss.

[73] Assignee: Tyrone Hydraulics, Inc., Corinth, Miss.

[21] Appl. No.: 554,522

[22] Filed: Mar. 3, 1975

Related U.S. Application Data

[63] Continuation-in-part of Ser. No. 452,713, Mar. 20, 1974, Pat. No. 3,868,821.

[51] Int. Cl.[2] ..... F15B 18/00

[52] U.S. Cl. ..... 60/421; 60/426; 60/468; 60/486; 91/412

[58] Field of Search ..... 60/421, 426, 428, 430, 60/468, 486; 91/412; 417/216, 426, 428, 286, 288

[56] References Cited

U.S. PATENT DOCUMENTS

| | | | |
|---|---|---|---|
| 2,616,264 | 11/1952 | Grant et al. | 91/412 |
| 2,797,551 | 7/1957 | Adams et al. | 60/426 |
| 3,355,994 | 12/1967 | Malott | 60/430 X |
| 3,535,877 | 10/1970 | Becker et al. | 91/412 X |
| 3,841,795 | 10/1974 | Ferre et al. | 417/216 |
| 3,868,821 | 3/1975 | Ratliff et al. | 60/421 |
| 3,916,767 | 11/1975 | Barton | 60/486 X |
| 3,924,971 | 12/1975 | Jacquot | 417/286 |

*Primary Examiner*—Edgar W. Geoghegan
*Attorney, Agent, or Firm*—Charles H. Lindrooth

[57] ABSTRACT

A control system for plural circuits having motor-driven hydraulic pumps. As disclosed, a pair of pumps is connected in a hydraulic actuating circuit individual to that pair and the circuit includes an hydraulically operated actuator to be advanced and retracted by fluid under pressure delivered from the pair of pumps of that circuit. A single prime mover drives the pair of pumps and pumps in other circuits, and each circuit has a pressure-responsive control valve which provides for unloading a pump of the first circuit in response to increases in pressure in the various other circuits to a predetermined value at which, in the absence of such unloading, the input horsepower requirement has risen toward a value which would stall the prime mover.- Pumps in several of the circuits may be sequentially and selectively unloaded.

18 Claims, 6 Drawing Figures

AUTOMATIC PUMP CONTROL SYSTEM

RELATED APPLICATIONS

This application is a continuation-in-part of our co-pending application Ser. No. 452,713 filed Mar. 20, 1974 now U.S. Pat. No. 3,868,821 granted Mar. 4, 1975.

BACKGROUND OF THE INVENTION

The invention is broadly useful in the field of hydraulically actuated equipment, being applicable, for example, to excavators which include at least two cylinders containing actuating pistons. It is known in such apparatus to provide separate circuits, each of which includes: hydraulic motor means which may be a cylinder and piston; two pumps; a manual control valve affording control of the position of the piston; and pressure-responsive valve means for unloading one of the pumps in response to high pressure existing in that circuit. In an excavator, as will be understood, the piston of one circuit may control the position of the stick, as during the crowding operation, and the other piston may rotate the bucket in the customary curling and dumping operations. Another pump may provide lateral movement for the assembly comprising bucket, stick and a boom. The tandem pumps mentioned above, or other pumps in a separate circuit may be used to supply two speed track drive, with either manual or automatic upshift and downshift. The invention is described in what follows, as applied to control of stick and swing assemblies.

In such systems it is usual that a single prime mover serves both to move the excavator and to drive several pumps, which supply the pressurized fluid for the pistons of the circuits. The pumps are typically arranged in pairs, and each pair forms part of one of the hydraulic circuits. In this arrangement the power required of the prime mover, for pumping purposes, is the sum of the power required at all pumps. The input horsepower requirement at the prime mover is a function of the flow rate of the pumps, the pressure existing in each circuit, and the overall efficiency of the pumping system.

Generally the pumps are driven at constant speed, and hence the flow rate (gals./min.) is very nearly constant. It follows that the input horsepower required of the prime mover, which is coupled to drive all the pumps, rises linearly with the pressures in the circuits, that is, with the pressures developed in the cylinder-piston actuators. When the pressure in any or all of the various cylinders or other hydraulically operated devices rises substantially, as frequently occurs during a digging operation, the required input horsepower advances toward, and may exceed, the maximum available horsepower. If the maximum is exceeded, the diesel or gasoline motor used as a prime mover will stall.

The prior art includes various arrangements intended to prevent such stalling by unloading one or more pumps, if the pressure in the cylinder circuits approaches a predetermined maximum value, and the present invention provides a novel and particularly advantageous unloading arrangement.

SUMMARY OF THE INVENTION

It is the general objective of this invention to provide what can be termed a "cross-over" or plural sensing unloading arrangement in which, if a motor in a first actuating circuit is not requiring substantial horsepower since it is operating under a lower pressure condition, and if motors in other circuits encounter a high load condition, the resultant elevated pressure in said circuits is utilized to unload a pump in at least one of the circuits. Specifically, the invention contemplates cross-over unloading of the pump which is requiring lesser horsepower, as well as other desirable unloading sequences to be referred to later in this description. Since the power required of the prime mover, for pumping purposes, is the sum of the power consumed at all the pumps, controlled unloading of the pumps is provided in order that power will be available where required, and to prevent stalling.

In the achievement of these advantages, the invention utilizes particularly designed pilot-operated unloading valves, in novel cross-over arrangement, and it is one object to provide these valves in such arrangement.

It is a further object to devise hydraulic motor-actuating circuits having cross-over unloading relief such that virtually any number of pumps may be unloaded in accordance with the pressures existing in a plurality of hydraulic circuits.

With particular reference to an excavator having stick bucket and swing circuits, it is a feature of the invention that, when an excess power requirement develops at the stick cylinder for example, as may occur during crowding, a pump which has been controlling curl is unloaded, increasing the power available for the stick cylinder. Should a similar overload exist at the bucket cylinder, it is sensed at the pressure-responsive control valve in the stick circuit, moving the stick circuit control valve to a position in which one of the pumps of the stick circuit is also unloaded. The pressure in the swing circuit is sensed by the control valves of the other circuits so that the unloading point does not exceed the point at which the vehicle will stall.

The pressures existing in the plurality of circuits may be summed and the sum of the pressures used to unload one or more pumps or the highest pressure prevailing may be used to cause unloading.

DETAILED DESCRIPTION OF THE PREFERRED EMBODIMENTS

Figure 1:
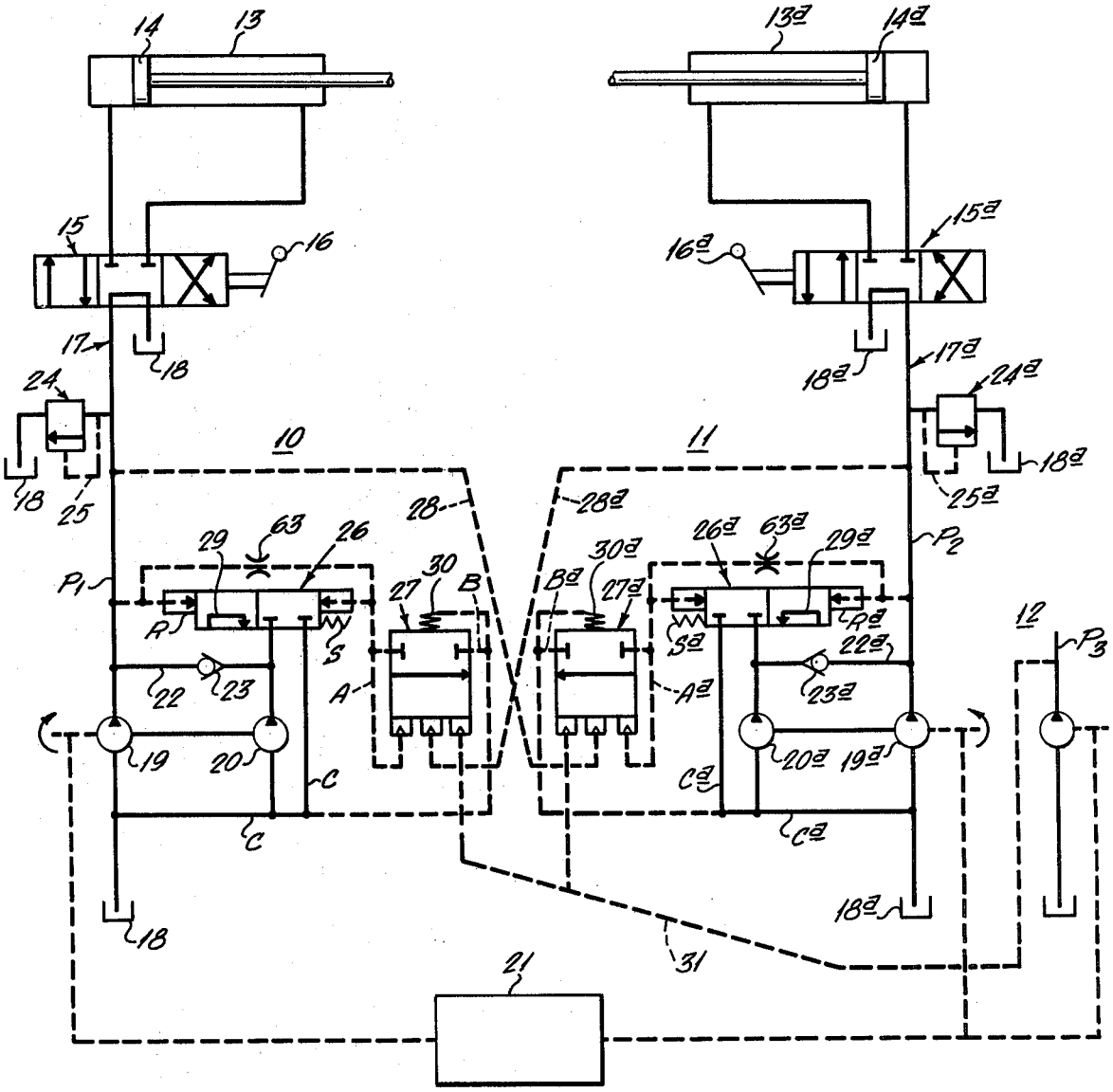
FIG. 1 is a schematic illustration of apparatus including three hydraulic circuits for actuating portions of a hydraulic implement, such as an excavator, said apparatus embodying the unloading arrangement characteristic of this invention.

With initial reference to FIG. 1, the hydraulic system illustrated comprises two similar circuits 10 and 11 and a third circuit 12 which for convenience of illustration comprises a single pump for operating a hydraulic motor not shown. Each circuit includes an element to be actuated by the output of the pumps common to that circuit, and a manually operable control valve for directing pressurized fluid from the pumps in such manner as to move the element in either of two senses. The circuits 10 and 11 further include unloading valves which are designed, in the illustrated embodiment, to respond to pressures communicated through cross-over connections so arranged that pressure above a predetermined relief point in one circuit will unload a pump in the other circuit. These circuits will now be described in greater detail with reference to circuit 10. Corresponding parts in circuit 11, which function in the same manner as circuit 10, bear the same numerals with the subscript *a*.

Further included in the illustrative embodiment of the invention is the third circuit 12, which may include a single swing pump for delivering fluid to a motor or other actuator, not illustrated. The pressure downstream from the pump in circuit 12 is communicated to the unloading valves in the other two circuits.

Cylinder 13 of circuit 10 houses a piston 14 which, when the apparatus is embodied in an excavator, should be understood as being connected to advance or retract an operating element, e.g. a crowd stick (not shown), during digging and dumping operations. Piston 14*a* in circuit 11 would then be connected to control a bucket (not shown). A manually operable valve of known type is represented conventionally at 15 in FIG. 1, and it will be understood without detailed description that this valve can be moved, by handle 16, from the illustrated center position to righthand or lefthand positions in which, respectively, the piston 14 is advanced or retracted with respect to the cylinder. In the center position there is no actuation of the piston 14 since the hydraulic fluid arriving through the pressure line 17 is bypassed directly to the fluid reservoir indicated at 18.

As illustrated, the pump means of each of circuits 10 and 11 comprises tandem pump means, preferably a pair of gear pumps, shown at 19 and 20 in circuit 10. As shown, the pumps are connected to be driven by a single prime mover 21 which may be the diesel or gasoline engine of the excavator. The power required of the prime mover 21 for pumping purposes is, of course, the sum of the power required at the four pumps and the pressure in circuit 12. Assuming low pressures prevail in the circuits, the fluid delivered to line 17 will be the composite flow derived from pump 19 and from pump 20, the latter through a connection 22 containing a check valve 23. The pressure of this composite flow is designated $P_1$, ($P_2$ in circuit 11), and exists downstream of the pair of pumps 19 and 20. This pressure is of course affected by the load encountered at piston 14, as will be understood by those skilled in this art.

The usual maximum pressure unloader appears at 24. This unloader is of the known bleed orifice type (see orifice 25), and is spring-adjusted to terminate all flow to the valve 15 and cylinder 13 in the event that $P_1$ rises to a maximum value. This value is greater than, and is to be distinguished from, the relief pressure values which result in unloading, and consequent reduction of the pumping capacity.

In particular accordance with one embodiment of the present invention, circuit 10 includes a pressure-operated unloading valve 26, with poppet-type pilot actuator 27, and a brief discussion of the nature and operation of these valves follows. This brief discussion is with reference to the schematic showings of FIG. 1, and will be followed by more detailed consideration of the construction of the valves 26 and 27, referring to FIGS. 2 and 4. In FIG. 1 the pilot parts and connections, which control valve 26, have been shown in broken lines.

In the lefthand position of valve 26, as it is shown in FIG. 1, the flow of fluid from pump 20 is through conduit 22 and check valve 23, and this flow is added to the flow derived from pump 19. The composite flow is available in pressure line 17 to control piston 14. Spring S biases the spool type valve 26 toward the illustrated lefthand position (as seen in FIG. 1) which it occupies during normal low pressure operation. Valve 26*a* in its lefthand position will provide flow from both of pumps 19*a* and 20*a* in circuit 11.

Consideration is now given to the novel unloading arrangements provided by this invention, it being assumed for exemplary purposes that the pump operating in the circuit at lower pressure is to be unloaded first, should an overload occur. Should a high pressure condition arise in circuit 11, due to excessive load encountered at piston 14*a*, this increase in pressure is communicated through cross-over passage 28*a* which extends from one side of pilot valve 27 of circuit 10 and maintains it in communication with pressure feed line 17*a* of circuit 11. It should be noted that the other cross-over passage 28 interconnects circuit 10 and one side of pilot valve 27*a* of circuit 11.

Valve 26 can be moved to its righthand unloading position (as seen in FIG. 1), against the pressure of spring S, under the control of pressures exerted at the pilot valve 27, as described below. When so moved, pump 20 is unloaded, since the flow therefrom passes to suction through a connection 29 and a conduit C which leads to fluid reservoir 18. Such unloading movement of valve 26 takes place under control of the pilot valve 27. The shift, or unloading point is determined by whether or not the pilot valve 27 is seated. Seating of the valve is, in turn, determined by the force of spring 30 and by other factors, including the pressure existing in circuits 10, 11 and 12, the latter being communicated via cross-over connections 28*a* and 31.

While the unloading operation, and the action of the pilot valve 27 in shifting the unloading valve 26, will be discussed in detail with reference to FIGS. 2–4, further brief reference to the schematic showings of FIG. 1 will facilitate an understanding of the more detailed description. Pressure in the line 17 of circuit 10 is sensed at one area of the pilot valve 27, via a conduit A which includes a restrictor 63, presently to be described. When the pressure sensed at the pilot valve 27 through the conduit A, plus the cross-over pressure communicated to the pilot valve through line 28*a* and the pressure communicated through line 31 (see the three parallel arrows at the bottom of the block representing valve 27) exceeds the force of spring 30, the pilot valve moves from the lower, seated position shown, that is from the position in which the pump 20 is not bypassed, to an unseated position. As explained below, the unloading sequence is a function of the relative areas of the pilot valve portions which are subject to the pressures in conduit A and lines 28*a* and 31, as well as the force exerted by the spring 30.

In the schematic showing of FIG. 1, the unseated position is an unillustrated upper position of the pilot valve in which it establishes a cross-passage through the pilot valve to the suction side of the pumps, through a portion of the conduit C. This cross-passage is designated B in the schematic showings of FIG. 1. Such upward, unseating, movement of the pilot valve 27 limits the force which was formerly assisting the spring S of control valve 26, in holding the spindle of said valve in its lefthand position. As a consequence, any further increase of the pressure communicated from line 17 (through the short conduit terminating in arrow R) results in a net force which moves the valve against the pressure of spring S and provides pressure relief by establishing a circuit through the unloading passage shown at 29. As will now be understood, when the valve 26 of circuit 10 has been moved to the right, the pump 20 is unloaded.

Figure 2:
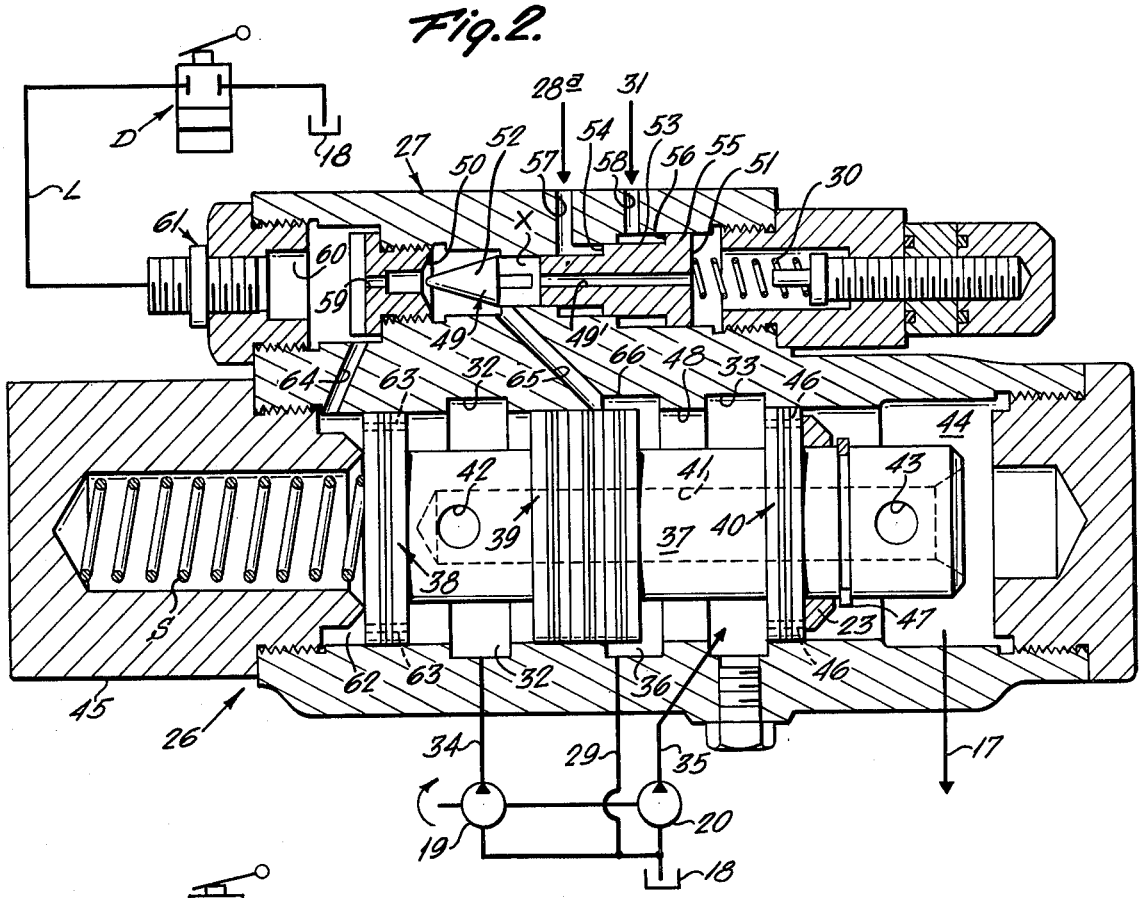
FIG. 2 is a partly sectional and partly schematic illustration of a pilot-operated pump-unloading valve of the kind included in two of the actuating circuits of FIG. 1.
Figure 3:
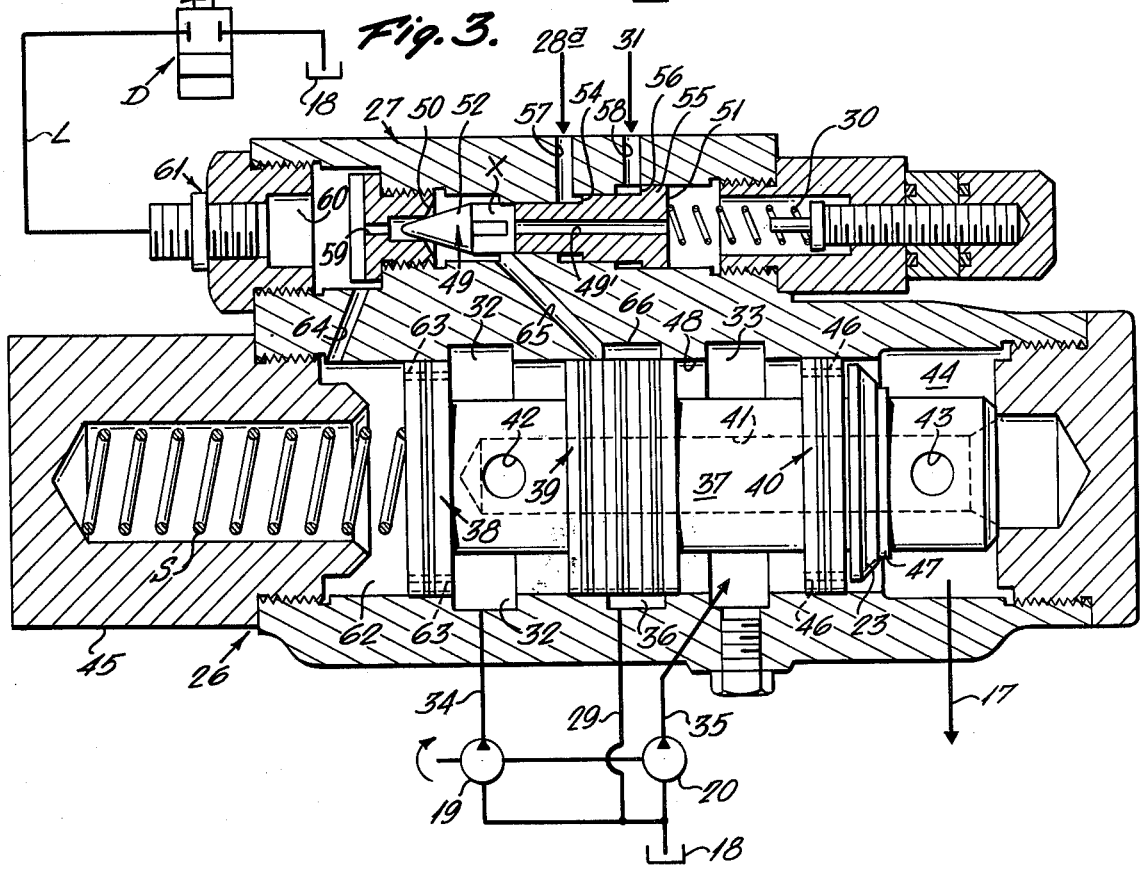
FIG. 3 is a view similar to FIG. 2, and illustrating the valve under a different condition of operation.

Now making more detailed reference to the construction of the control and poppet valves, and referring to FIGS. 2 and 3, it will be seen that the control valve 26 (and of course the similar valve 26*a* of circuit 11) is provided with a pair of inlet chambers 32 and 33 connected, respectively, to pumps 19 and 20 by passages 34 and 35. An outlet chamber 36 communicates with the unloading passage 29 to return fluid to suction when the pump 20 is unloaded. The unloading movement of the valve 26 is under control of the pilot valve 27.

The valve 26 is provided with a central bore containing a spool 37 mounted for shiftable movements within the bore between a first or lefthand position shown in FIG. 2, in which unloading of pump 20 occurs, and a righthand position in which the flow to pressure line 17 of circuit 10 is the composite flow derived from both the pumps 19 and 20. Spool 37 is provided with a plurality of lands 38, 39 and 40 and with a bore 41 which is shown in dotted lines in FIGS. 2 and 3 and extends longitudinally throughout the major portion of the length of the spool 37. The lands 38, 39 and 40 confine the fluid within chambers formed by the central bore of the valve body and by side walls of the lands, and channel it through the various passageways. Orifices are provided through the wall of spool 37. One of these is shown at 42, and it comprises an inlet passage extending transverse the longitudinal axis of the spool and communicating with the bore 41 thereof. An outlet orifice shown at 43 is also bored radially inwardly through the wall of the spool. The described arrangement provides for flow of fluid from inlet passage 34 to an outlet or discharge chamber 44 which leads to pressure line 17 of circuit 10, the flow being via chamber 32, inlet orifice 42, spool bore 41, outlet orifice 43, and discharge chamber 44. Biasing means comprising the coil spring S urges the spool 37 to the righthand position shown in FIG. 3, in which both pumps are in circuit. A cap 45 retains the spring S in position in which it bears against the spool through land 38, said cap also preventing external leakage.

Flow from pump 19, through conduit 34, always enters inlet chamber 32, which lies between lands 38 and 39 in either position of the spool, and hence always reaches discharge chamber 44 in the manner described above. When the spool occupies the righthand position shown in FIG. 3, the flow derived from pump 20, which enters the inlet chamber 33 as described above, passes through holes 46 provided in land 40 and thence traverses the ring type check valve 23 which is readily moved off its seat and against the stop 47, since essentially the same pressure exists in both of chambers 33 and 44. Under this condition, the flow from pump 20 is discharged to the pressure line 17 of the associated load, as described. The check valve 23 is mounted for axial movement on the spool 37 and is movable back to a position in which it closes the openings 46 (FIG. 2), to prevent fluid flow from discharge chamber 44 back to inlet port 33.

When the spool 37 of valve 26 shifts to the unloading position, that is to the lefthand position illustrated in FIG. 2, pump 20 is unloaded, since its output, supply to inlet chamber 33, flows laterally through chamber 36, which has been uncovered by lefthand movement of land 39, and via which it flows back to suction through conduit 29.

As explained above, and with reference to the embodiment herein described, if the input horsepower required to drive the pumps of all circuits tends to exceed the maximum available horsepower, as indicated by the sum of pressures P1, P2 and P3, then the valve 26 is moved, in the manner described below, against the force of spring S, to the lefthand position shown in FIG. 2, in which the flow from pump 20 is bypassed. This is the condition under which the poppet 49 of valve 27 is unseated, and is illustrated in FIG. 2.

The valve device 27 is responsive to pressure above any preselected limit. As described with reference to FIG. 1, it is in communication with the pressure existing in circuit 10, via line 17 (this being the circuit under primary consideration for purposes of this description), as well as the pressure which is communicated from circuit 11 through cross-over connection 28*a* and the pressure communicated from circuit 12 through cross-over connection 31. The shift, or unloading point is determined by whether or not the poppet 49 of pilot valve 27 is seated. The relief pressure which will displace the valve from its seat 50 is, in turn, determined by the force of its spring 30, and by pressures in the three circuits, which pressures are brought to bear against particular areas of the poppet device, as described just below.

Figure 4:
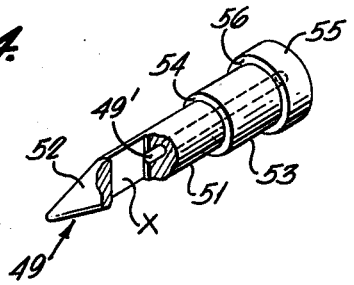
FIG. 4 is an isometric view of a poppet valve member used in the pilot mechanism of FIGS. 1, 2 and 3.

As shown in FIG. 4, the poppet valve per se comprises a hollow spindle 51 terminating in a conical surface 52 which is the surface which engages the seat 50. The opposite end of the poppet 49 is stepped radially outwardly, as appears at 53, to provide an annular surface 54 against which pressure existing in cross-over connection 28*a* is brought to bear. In the embodiment illustrated, a second radial step outwardly as appears at 55 provides a second annular surface 56 against which pressure in a cross-over connection 31 is brought to bear. As is apparent from FIGS. 2 and 3, cross-over connection 28*a* terminates at an inlet port 57 formed in the housing of the pilot valve 27. Cross-over connection 31 terminates in a second inlet port 58 adjacent port 57. Spring 30 urges the poppet device toward its lefthand or seated position (FIG. 3), from whence it can be unseated by pressures exerted against annular surfaces 54, 56 and against tapered surface 52. As seen below, unseating of the valve is a function of the force of spring 30 and of the ratio between the areas 52, 54 and 56, against which are exerted the pressures existing in the three circuits. The pressure at surface 52 is communicated through an aperture 59 formed in the valve seat and which aperture is, in turn, in communication with the pressure existing in chamber 60. The latter chamber is closed by a plug and nipple 61 to which is connected a line L, leading to a manually controllable dumping device D. Opening of the device D unloads the pumps through chamber 60 and line L. The resultant control by dumping fluid is particularly useful when the bucket (not shown) is used to position objects, for example pipes, in an excavation. Under such usage, control by dumping is often superior to reducing engine speed.

Chamber 60 communicates with chamber 62 of control valve 26 through a passage 64. Chamber 62 is also in communication with chamber 32, through a restricted aperture 63. In the described arrangement the conical surface 52 of the poppet device 49 is subject to pressure which is a function of that existing in chamber 32 of the control valve which, as described, is communicated to the pilot valve through the restriction 63, passage 64, and chamber 60 of the pilot valve assembly. In brief, whenever the poppet device 49 is seated, i.e., when both of pumps 19 and 20 are under load, the poppet is subject to the pressure existing in line 17 of system 10 (via spool bore 41 and chambers 44 and 32) and said pressure is exerted against the conical face 52 of the valve. It is also subject to the cross-over pressure exerted against the stepped surfaces, 54 and 56. The sum of the forces created by these pressures is of course, in opposition to that exerted by the spring 30. In the embodiment presently described, the area of the surface 52, which is subject to the pressure in chamber 32 (circuit 10 discharge pressure), the area 54 which is directly subject to the cross-over pressure in circuit 11, and the area 56 which is subject to the pressure in circuit 12 are chosen, as is the force of spring 30, so that pump 20 of circuit 10 is unloaded when the pressure in circuit 11 exceeds a predetermined limit. There is essentially no pressure in the spring cavity because it is vented via a central bore 49', slots *x* (see particularly FIG. 4) and passage 65 to which further reference is made below.

It will now be appreciated that the pressure created at pump 19 is always communicated with the line 17 of circuit 10, via the inlet orifice or cross-passage 42, central bore 41 and cross-passage or outlet orifice 43 of the spool of control valve 26. During low pressure operation of the valve 26, it occupies its right-hand position (FIG. 3) and pump 20 also delivers fluid to the line 17, as already described.

Since, as stated above, the pressure in chamber 32 of valve 26 is always the same as the pressure in chamber 44 thereof, in view of the communication through the valve spool, and it will therefore be observed that the pressure existing in chamber 60, just ahead of poppet 49, is also a function of the discharge pressure of the valve 26, via restrictor 63 and the generally radial passageway 64, which places the valve 26 in communication with the chamber 60. During low pressure operation the pressures in chambers 62 and 44 are substantially equal. The force of spring S then maintains the spool 37 at the righthand end of its bore (FIG. 3).

In summary, the cross-over unloading arrangement of the invention, as thus far described, includes such a ratio between areas 52 and 54 that, if the piston in one circuit encounters a high load condition, the resultant elevated pressure in said one circuit unloads one of the pumps in the other circuit, leaving more power available for the piston circuit which has encountered high load. Should a high load condition then develop in said other circuit, there will be unloading of one of the pumps in said one circuit, with the result that the power available at the prime mover is divided between the remaining pumps. Both circuits are subject to the pressure in circuit 12 which pressure is shown applied to surface 56 in FIGS. 2 and 3. Thus a high load condition in circuit 12 may be effective to unload a pump in either or both of circuits 10 and 11. The action of the described embodiment can be summarized as follows, it being assumed that the initial overpressure develops in circuit 11.

The pressure acting on the lefthand side of the spool 37 of valve 26 in circuit 10, that is the pressure existing in chamber 62, is exerted against the conic face 52 of the pilot poppet valve 27 because of the presence of the passageway 64. This pressure, plus the pressure communicated from circuit 11 (through conduit **28*a*) acting on the area presented by the annular face 54 of stepped spindle 51, and the pressure acting on the annular face 56, will, at a particular relief value determined in advance, produce a force that exceeds the force exerted by spring 30, and hence unseat the poppet valve. Such movement of the poppet valve to the position shown in FIG. 2 opens up the passageway through the valve seat 50 and thence through the diagonal passageway 65 in the body of valve 26, to a groove 66 which is in communication with discharge chamber 36 which leads to discharge line 29. The result is that the pressure on the lefthand side of the spool 37 is not allowed to exceed the particular relief value. A further increase in pressure in circuit 10 or 11 acts to force the spool 37 to its lefthand position (FIG. 2) and the pump 20 is unloaded to suction, all as considered above with reference to the schematic showings of FIG. 1**.

Should the pressure in circuit 10 continue to exceed the limit, after initial unloading, the cross-over connection 28 which leads to circuit 11, and the control and pilot valves **26*a* and 27*a* of circuit 11 provide relief by unloading pump 20*a* of the latter circuit. As noted above, should either P1, P2 or P3 rise to a maximum value above the relief limit, the safety unloader of the affected circuit (e.g. the unloader 24 of circuit 10**) will operate to bypass to reservoir both pumps of such affected circuit.

While the system as thus far described results in unloading of a pump at lower pressure, in a first circuit, in response to a piston, in a second circuit, encountering a load which increases the pressure, in the second circuit, above a predetermined relief value, it should be understood that the system may be preset to produce unloading in any one of four specific priority sequences. These different unloading sequences are:

(1) The unloadable pump subject to the lower pressure in its individual circuit unloads first, as is the case in the embodiment described above;

(2) The unloadable pump subject to the higher pressure in its individual circuit unloads first;

(3) The unloadable pump in circuit 10 unloads first, regardless of which circuit is encountering the overload;

(4) The unloadable pump in circuit 11 unloads first, regardless of which circuit is encountering the overload;

(5) In addition, the unloadable pump in both circuits or in any selected circuit or in any sequence may be unloaded in response to high pressure in circuit 12.

These different sequences, and the relief values at which they occur, are achieved by proper selection of the force of springs 30, **30*a*, and by suitable control of the size of, and ratios between, the areas 52 and 54 and 56 of the poppet devices. Such selection of spring constants, and of ratios between the poppet-actuating areas, in the valve assemblies of the two circuits, is all that is required to provide relief at the desired settings and in the selected sequence. Specifically, selection of the ratio of areas determines whether operation under sequence 1 or 2 is achieved, and selection of the force of the poppet spring in one valve assembly, relative to the force of the poppet spring in the other assembly, determines whether unloading is in accordance with sequence 3 or 4**.

Figure 5:
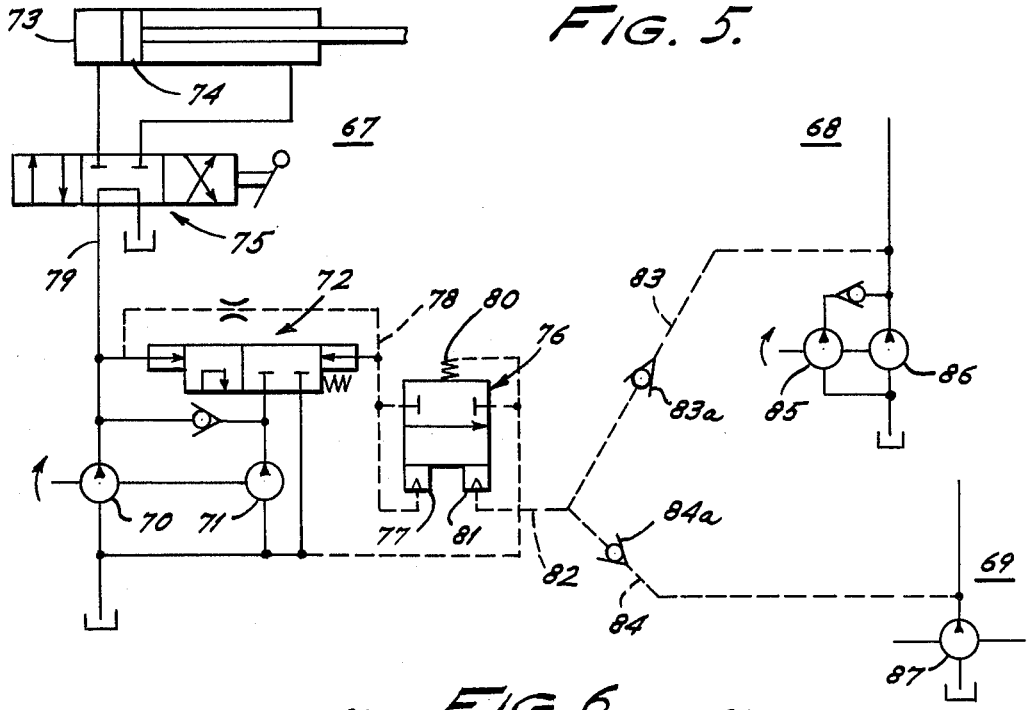
FIG. 5 is a schematic illustration of an alternative form of apparatus embodying the unloading arrangement of the present invention.

Another embodiment of the invention is disclosed in FIG. 5. In the embodiment of FIG. 5, three independent circuits 67, 68 and 69 are disclosed. In circuit 67, two pumps 70 and 71 are provided, with flow from pump 71 being under control of an unloading valve 72 which functions like valve 26.

Circuit 67 is provided with the usual implement schematically represented by the cylinder and piston 73 and 74 respectively and a manually operable three position control valve 75, which operates similarly to control valve 15 disclosed above. Also included is a pilot actuator which may comprise pilot valve 76. Pressure is applied to one area of the pilot valve indicated at 77 via a pilot line 78 which communicates with pump discharge passageway 79. The pilot valve is biased to the closed position by means of a spring 80. A second pressure area 81 provides for an application of pressure derived from circuit 68 or 69. As indicated in FIG. 5, the pressures opposing the force of spring 80 are thus the pressures applied at the pressure areas 77 and 81.

Line 82 leads to the pressure area 81. Branch lines 83 and 84 lead from the pump discharge passageways 68 and 69, respectively, to the line 82. Passageways 83 and 84 are provided with check valves 83*a* and 84*b* respectively, for purposes to be described hereafter.

For purposes of illustration, circuit 68 is shown as a dual pump system having pumps 85 and 86 for delivery of fluid under pressure to an implement, not shown. Circuit 69 is shown schematically as a single pump 87. Both of circuits 68 and 69 may be provided with unloading valves if desired and may include cross-over lines whereby the pressures in any one or all of the circuits may influence unloading of a pump in any one of the circuits.

Figure 6:
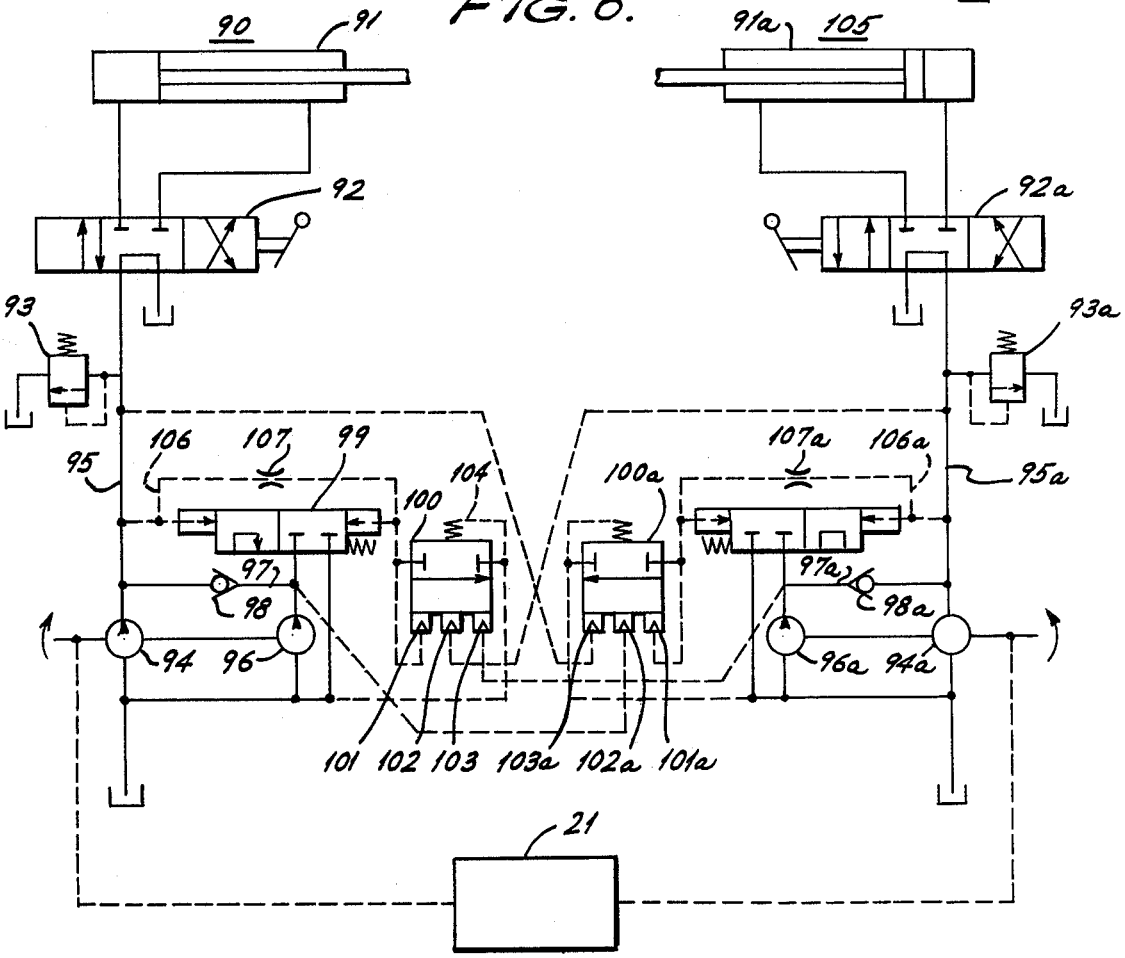
FIG. 6 illustrates another form of the invention.

In the embodiment of FIG. 5, check valves 83*a* and 84*a* function to block off line 83 or 84 depending on the relative pressures in the two lines. If the pressure prevailing in line 84 is higher than the pressure in line 83, check valve 83*a* will be held closed and the higher pressure is applied against pressure area 81. Conversly if the pressure in line 83 is the higher, check valve 84*a* will be held closed and the pressure in line 83 will be communicated to pressure area 81. Thus the higher of the pressures prevailing in the circuits 68 and 69 will be operative to open the pilot valve 76 in conjunction with pressure prevailing in circuit 67. As in the other disclosed embodiment, when the predetermined pressure is attained, the pilot valve 76 opens and the unloadable pump is unloaded to the reservoir. In FIG. 6, two circuits, each having dual pumps are disclosed. The pumps in the first circuit 90 deliver fluid to an implement 91 via a manually controlled valve 92 in the manner described above. The usual pressure unloading safety valve is shown at 93. Pump 94 delivers fluid directly from the reservoir to the implement through line 95. The second pump 96 delivers fluid through a passageway 97.

Pump 96 is the unloadable pump of the pair and is controlled by an unloading valve 99 of the type discussed above. A pilot valve 100 having three pressure areas 101, 102, and 103 controls the shifting of the valve 99 to the loading or unloading position in accordance with the sum of the pressures acting on the pressure areas as opposed to the force exerted by a spring 104. The second circuit 105, is shown to be identical to the circuit 90 and the parts in that circuit which are the same as the parts in circuit 90 are identified by the same numbers followed by the subscript *a*.

As shown in FIG. 6, the pressure areas of the pilot type actuator 100 are connected so that the pressure prevailing in circuit 90 is applied to the pressure area 101 via pilot line 106 and restriction 107. The pressure prevailing in circuit 105 is applied to pilot area 102. The discharge pressure of unloadable pump 96*a* is applied to pilot area 103. The pressures acting on the actuating means of the pilot valve 100*a* are the pressure in line 95*a* which is applied to pressure area 101*a* via pilot line 106*a* and restriction 107*a*. The pressure in line 95 is applied at pressure area 103*a* and the discharge pressure of unloadable pump 96 is applied at pressure area 102*a*. In considering the operation of the embodiment of FIG. 6, it should be noted that one of the pressures applied to each of the pilot valve actuators is the discharge pressure of an unloadable pump in the other circuit. When this pressure drops to zero, as occurs when that pump is unloaded, the pressure on that particular area of the pilot valve actuator will also drop to zero. Thus assuming that a high pressure condition occurs in circuit 105, that pressure will be communicated to the pilot pressure area 102. The discharge pressure of unloadable pump 96*a* is applied to pilot pressure area 103 and the pressure in passage 95 is applied to area 101. If these pressures reach or exceed the control point, pilot valve 100 moves to the open position and valve 99 shifts to the position in which pump 96 unloads. When pump 96 unloads, the pressure at pressure area 102*a* drops to zero and pilot valve 100*a* will move to the unloading position only when and if the sum of the pressures in line 95*a* as applied to area 101*a* and the pressure in line 95 as applied to area 103*a* exceed the preselected value.

It should be evident from the foregoing that the pilot valves disclosed in each embodiment may be provided with a multiplicity of pressure areas each of which communicates with a circuit having pumps driven by the common prime mover. The pilot valves serve as means for unloading pumps in various sequences so that the prime mover is never overloaded. Any pressure area may be supplied with pressure from a plurality of circuits and check valves may be provided in one or more of the passageways leading to the other circuits so that the circuit having the higher pressure condition will operate to unload the pump in the circuit controlled by the pilot valve. Further, as indicated above, the pressure areas may be sized relatively to one another so as to provide for a desired priority of unloading.

The various embodiments disclosed give variable volume performance with constant volume pumps and valving. The unloading valve systems are extremely simple. Operation of systems incorporating the invention is extremely smooth and in use, experienced operators are unable to feel any difference between operation of the systems of the invention and variable volume systems. The available power in the engine is utilized more effectively than with prior multiple pump systems, allowing for increased material handling speeds by maximizing the pressure that can be exerted on the hydraulic circuit without overloading the prime mover.

What is claimed is:

1. In a hydraulic control system of the type including a plurality of hydraulic circuits, each circuit having pump means driven by a prime mover common to all circuits for pumping hydraulic fluid from a reservoir to a hydraulically operated implement individual to its circuit, the pump means in one of said circuits comprising a plurality of pumps and means for unloading one of said pumps including a pilot valve actuator having a plurality of pressure areas, means for applying pressures prevailing in said circuits against said pressure areas, said pilot valve actuator being shiftable to a position in which said one pump is unloaded when the sum of the pressures applied to said pressure areas reaches a preselected value.

2. A control system according to claim 1, wherein said pilot valve actuator is provided with a plurality of annular surfaces, each of which forms one of said pressure areas.

3. A control system according to claim 2 wherein said pilot valve actuator includes a poppet type valve having a conic face against which the pressure in said one circuit is applied, said valve having a shank provided with a plurality of steps each of which forms one of said annular pressure areas, and wherein pressure prevailing in at least one of the other of said circuits is applied against said annular pressure areas.

4. A control system according to claim 1 wherein said plurality of circuits comprises three circuits and wherein means are provided for applying the higher of the pressure values prevailing in the other two circuits to one of said pressure areas.

5. A control system according to claim 4 wherein said means for applying the higher of the pressure values comprises a branched passage leading from said last named pressure area to each of said circuits with check valve means in each branch.

6. A control system according to claim 1 wherein said plurality of circuits comprises two circuits each comprising a pair of pumps for supplying operating fluid to an implement individual to that circuit and a pilot valve actuator in each circuit having three pressure areas, means for applying to one of said pressure areas of the pilot valve actuator of each circuit the pressure prevailing in that circuit and the pressure prevailing in the other circuit downstream from both pumps of the other circuit to the second pressure area of each pilot valve actuator, and means for applying the discharge pressure of the unloadable pump in the other circuit to a third pressure area of each pilot valve actuator.

7. In a hydraulic control system comprising three hydraulic circuits, each circuit having pump means driven by a common prime mover for pumping hydraulic fluid from a reservoir to a hydraulically operated implement individual to that circuit, the pump means in one of said circuits comprising a plurality of pumps and means for unloading one of said plurality of pumps including a pilot valve actuator means responsive to the pressures prevailing in the circuits for unloading said one pump in response to a pressure value in excess of a preselected value.

8. A hydraulic control system according to claim 7 wherein said pilot valve actuator means includes means responsive to the sum of the pressures prevailing in said circuits for unloading said one pump when a preselected pressure value is reached.

9. A hydraulic control system according to claim 7 wherein said pilot valve actuator means includes means responsive to the sum of the pressure in the circuit having said unloadable pump and one of the pressures in the other two circuits for unloading said pump when the sum of said pressures reaches a predetermined value.

10. A hydraulic control system according to claim 9 wherein the pressure responsive means is responsive to the sum of the pressure in the circuit having said unloadable pump and the higher of the pressure values in the other two circuits.

11. In a hydraulic control system of the kind including a plurality of hydraulic circuits each having a pair of fluid supply pumps to be driven by a prime mover common to said circuits, each having an actuator to be operated by the pressurized hydraulic fluid in the circuit, and each circuit further including means for controlling the flow of fluid to the actuator of that circuit, the improvements which comprise: means in each circuit movable to unload one pump of that circuit; and means for effecting such movement of the movable means in response to fluid pressures increasing above a value determined by the available power of the common prime mover.

12. A system in accordance with claim 11, and further characterized in that said movable means comprises pressure-responsive valve means, and said last means comprises fluid flow conduit means cross-connecting the pressure-responsive valve means of each circuit with the other circuit.

13. A system in accordance with claim 12, and in which the valve means in each circuit includes, a part shiftable in response to a predetermined pressure difference thereacross to effect such unloading, and a pilot valve so disposed in circuit with said conduit means as to subject said part to such pressure difference when the pressure in the other circuits increases above said predetermined value.

14. A system in accordance with claim 13, and in which said pilot valve includes a poppet member subject to a force which biases it toward a closed position in which it does not subject said part to such difference, said poppet member being so connected in the system as to be subject to forces which oppose its bias, one such force being a function of a pressure prevailing at one side of said shiftable part, and the other such forces being a function of the pressures existing in the other circuits and communicated through said conduit means.

15. A system in accordance with claim 12, and in which said valve means comprises: a spool type control valve responsive to a predetermined imbalance of pressures thereacross to move to unloading position; and a poppet type pilot valve in communication with said spool valve and said conduit means and which, when unseated, subjects said spool valve to such imbalance of pressures, said poppet valve having a plurality of annular pressure areas against which the pressures in the other circuits are applied whereby the poppet is unseated when the pressure in said circuits increases above said predetermined value.

16. In a hydraulic control system of the type including at least three hydraulic circuits, and pump means individual to each circuit driven by a prime mover common to all circuits, the pump means of at least one circuit comprising two pumps: fluid flow control means in each circuit for directing fluid from the pump means to an implement indivdual to that circuit and means for unloading one pump of said one circuit, said latter means being responsive to the fluid pressure in any circuit increasing above a predetermined limit.

17. In a system in accordance with claim 16, the further characterization that said last recited means comprises pressure-responsive valve means in said one circuit movable to an unloading position, and conduit means for subjecting said valve means to the pressures prevailing in the three circuits.

18. In a system in accordance with claim 17, the further feature that one of said other circuits is also provided with pressure-responsive valve means movable to an unloading position, for unloading a portion of the fluid discharged by the pump means in that circuit, and in which system there is provided additional conduit means for subjecting the latter valve means to the pressure prevailing in the three circuits to shift said last named valve means to the unloading position in response to pressures above a predetermined value.

* * * * *